US005480365A

United States Patent [19]

Lundin et al.

[11] Patent Number: 5,480,365

[45] Date of Patent: Jan. 2, 1996

[54] FOLDABLE HANDLEBAR FOR EXERCISE MACHINE

[75] Inventors: Christopher B. Lundin, Mantua, N.J.; John Nelson, Levittown, Pa.

[73] Assignee: Physia, Inc., Bellmawr, N.J.

[21] Appl. No.: 288,311

[22] Filed: Aug. 10, 1994

[51] Int. Cl.[6] ..... A63B 21/00; B62K 21/16

[52] U.S. Cl. ..... 482/53; 482/57; 74/551.3

[58] Field of Search ..... 482/51, 52, 53, 482/148, 57, 908, 62, 63; 74/551.3, 551.4, 551.5, 551.6, 551.7

[56] References Cited

U.S. PATENT DOCUMENTS 4,688,817 8/1987 Marier ..... 74/551.7
4,943,049 7/1990 Lo ..... 482/52
5,160,305 11/1992 Lin ..... 482/57
5,265,969 11/1993 Chuang ..... 74/551.3
5,316,529 5/1994 Wang ..... 482/53
5,327,798 7/1994 Lerch ..... 74/551.4
5,346,357 10/1994 Wang et al. ..... 482/57

*Primary Examiner*—Stephen R. Crow
*Attorney, Agent, or Firm*—Norman E. Lehrer; Jeffrey S. Ginsberg

[57] ABSTRACT

A foldable handlebar for an exercise machine of the type that has a base frame, laterally spaced foot support members carried by the base frame, and a main strut attached to the base member and extending upwardly therefrom. The handlebar is rotatably attached atop the main strut so that each individual user can adjust the handlebar to accommodate his or her particular measurements.

8 Claims, 5 Drawing Sheets

FOLDABLE HANDLEBAR FOR EXERCISE MACHINE

BACKGROUND OF THE INVENTION

The present invention is directed toward an exercise machine for providing a cardiovascular workout and, more particularly, to such an exercise machine having a base frame, a pair of stepping members and handlebar which is adjustable and also foldable for easy storage.

During the last few years step climber exercise machines have become an increasingly preferred method for obtaining a cardiovascular workout. Such machines are also used to tone and shape a person's body. One reason for this trend is the fact that step climber exercisers, commonly referred to as steppers, cause significantly less stress to the knee area than jogging and/or running. Additionally, steppers allow the user to exercise without ever leaving his or her own home.

Step climber exercisers are well known in the art. Such exercise machines are shown, for example, in prior U.S. Pat. Nos. 5,232,420 and 5,230,674. These exercisers are deficient in that they do not have handlebars or other means to allow the user to balance himself during a workout.

Furthermore, the above mentioned devices as well as other known step climbers are not designed to accommodate exercises where the user's posterior extends passed the foot supporting members. See, for example, U.S. Pat. Nos. 4,496,147 and 4,563,001. This prevents the user from tailoring a workout to concentrate certain areas of his or her body. For example, if the user wanted to concentrate on exercising the hamstring area on the back of the leg as well as the glutimus maximus area, the user would preferably have his or her posterior extend passed the foot supporting members while exercising. However, the above mentioned devices do not provide the balance required to accommodate such a position and would tip over if such exercises were attempted.

As stated above, step climber exercisers are often used in the privacy of one's home. Some known home fitness devices are foldable so that they can be stored away when not in use. A common drawback to many of these devices is that they are not readily collapsible and require significant effort to be placed in the storage position.

Accordingly, there is a need for a step climber exerciser that allows the user to perform a variety of different exercises without tipping over and is readily collapsible so that it can be stored.

SUMMARY OF THE INVENTION

The present invention is designed to overcome the deficiencies of the prior art discussed above. It is an object of this invention to provide a device for simulation of step climbing.

It is a further object of this invention to provide a step climber exercise machine that provides the balance needed to allow the user to perform exercises where his or her posterior extends passed the foot supporting members.

It is yet another object of the invention to provide such a device that can be conveniently stored when not in use.

In accordance with the illustrative embodiments, demonstrating features and advantages of the present invention, there is provided a step climber exercise machine which comprises a base frame having a support bar telescopically mounted therein, a pair of stepping members pivotally secured to the base frame, a main strut attached to the base frame, extending upwardly therefrom and a handlebar adjustably secured atop the main strut. Resistance means are secured to the stepping members, for providing resistance when a downward force is placed on the stepping members by the user.

The user may simulate step climbing by repeatedly stepping up and down on the stepping members. The resistance means can be adjusted to provide a desired level of resistance.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
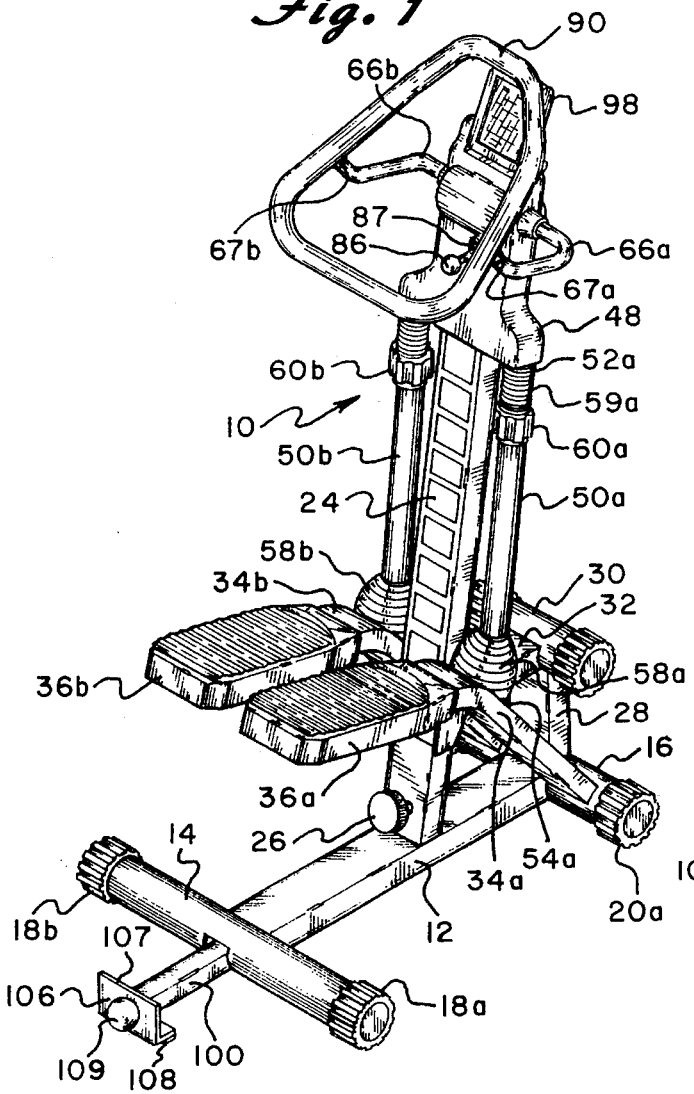
FIG. 1 is a rear perspective view of a step climber exercise machine constructed in accordance with the present invention.

Referring now to the drawings in detail wherein like reference numerals have been used throughout the various figures to designate like elements, there is shown in FIG. 1 a collapsible step climber exercise machine constructed in accordance with the principles of the present invention and designated generally as 10.

The step climber exercise machine includes a base frame having a base member 12, a transverse rear segment 14 and a transverse front segment 16. In the preferred embodiment, the rear segment 14 and the front segment 16 each include a pair of spaced apart caps, 18*a*, 18*b* and 20*a*, 20*b* respectively, that are adapted to frictionally engage the ground when the step climber is in use.

Channel member 22 is attached to the base member 12, preferably by welding the same thereto. However, it can be secured to base member 12 in a number of other ways. Pivot plate extends from the top of channel member 22. Main strut 24 is partially inserted through pivot plate 27 and into channel member 22 when the exercise machine is in its operating condition (see FIGS. 3 and 6).

Figure 6:
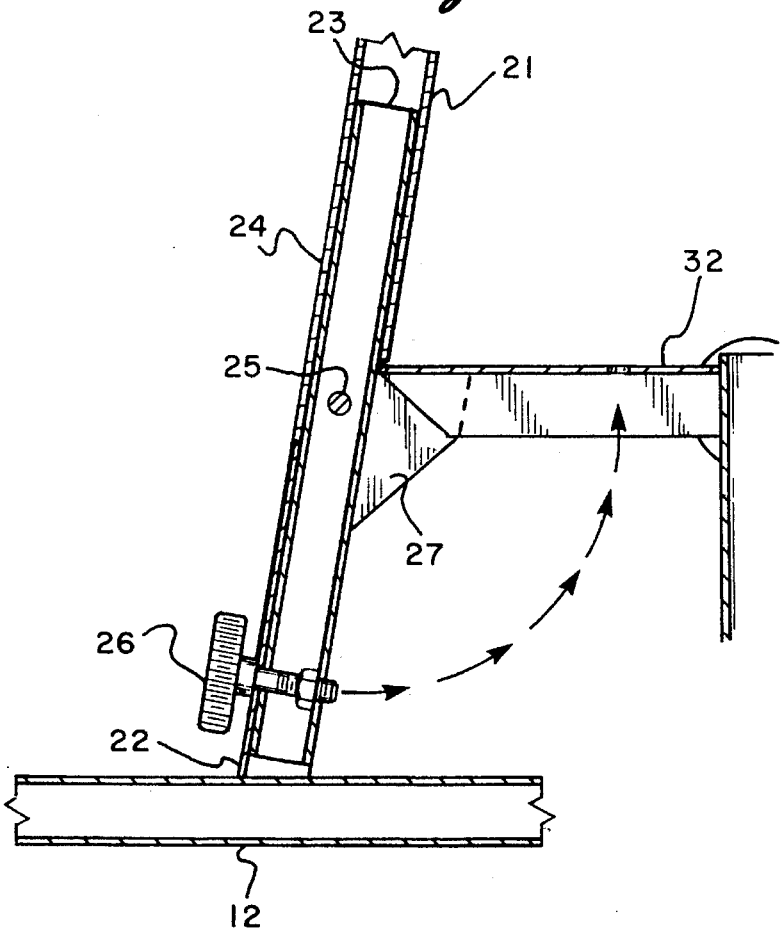
FIG. 6 is a partial cross-sectional view of the main strut raised in the operating position.
Figure 7:
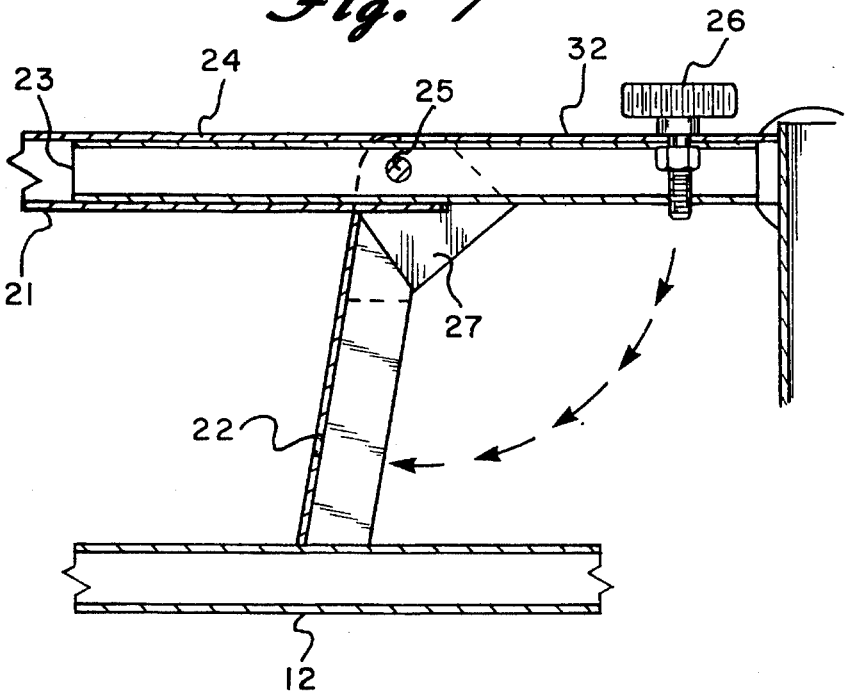
FIG. 7 is a partial cross-sectional view of the main strut shown in the storage position.

In the preferred embodiment, the main strut 24 is comprised of an outer segment 21 and an inner segment 23. The inner segment 23 is friction fitted in the outer segment 21. The inner segment 23 extends from the outer segment 21 and is pivotally connected to the pivot plate 27 at pivot point 25 as illustrated in FIGS. 6 and 7. Screw knob 26 secures the inner segment 23 of main strut 24 to the channel member 22 when the exercise machine is in its operating condition. In an alternate embodiment, the main strut can be one molded piece comprising a large diameter segment and a reduced diameter segment extending therefrom.

Front support 28 is secured to transverse front segment 16. Beam 30 is attached atop the front support 28. Positioned between the channel member 22 and beam 30 is horizontal housing 32. The end of the horizontal housing 32 furthest from beam 30 extends into pivot plate 27. The horizontal housing 32 has an open bottom for receiving the inner segment 23 of main strut 24 when screw knob 26 is manually removed and the step climber 10 is collapsed from its operating position to its storage position as described below.

Figure 4:
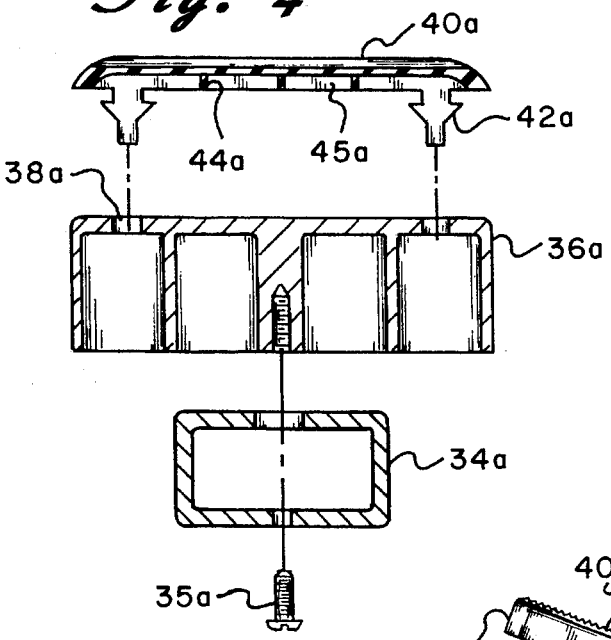
FIG. 4 is a cross-sectional view of the foot supporting segment.

Right and left laterally spaced stepping members **34*a*, 34*b* are pivotally mounted to front segment 16. The right and left stepping members 34*a*, 34*b* are substantially identical to each other. Accordingly, only one of the stepping members will be described in detail, it being understood that the description applies equally to the other stepping members. The foot supporting segment 36*a* is partially inserted over stepping member 34*a*. Screw 35*a* secures foot supporting segment 36*a* to stepping member 34*a* as shown in FIG. 4. The foot supporting segment 36*a* has a plurality of apertures 38*a*** formed therein.

Figure 5:
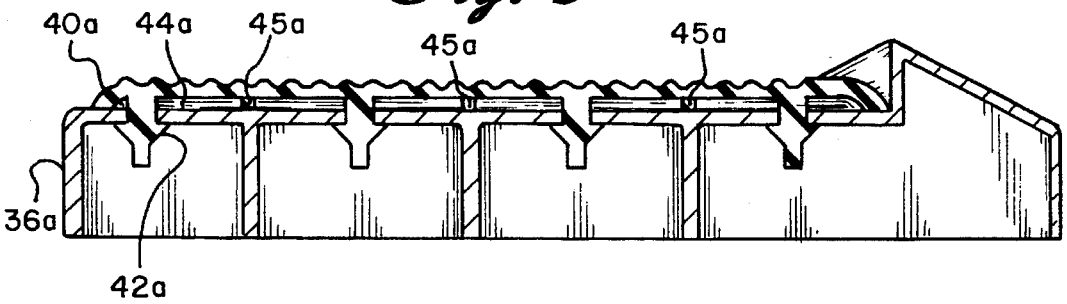
FIG. 5 is a cross-sectional side view of the compressible mat of the foot supporting segment.

A compression mat **40*a* is secured atop foot supporting segment 36*a* by means of barbed extensions 42*a* friction fitted in the apertures 38*a*. Compression mat 40*a* has a plurality of longitudinal and latitudinal projections 44*a* and 45*a*, respectively, extending downwardly from the undersurface of the mat as shown in FIG. 5. The projections are preferably made of an elastic material such as rubber. When the user steps down on segment 36*a*, the projections 44*a* and 45*a* of compression mat 40*a* are slightly compressed so that the user encounters a cushioned surface. The top side of compression mat 40*a* includes a plurality of elongated ribs 46*a*** for providing a non-slip gripping surface.

Figure 2:
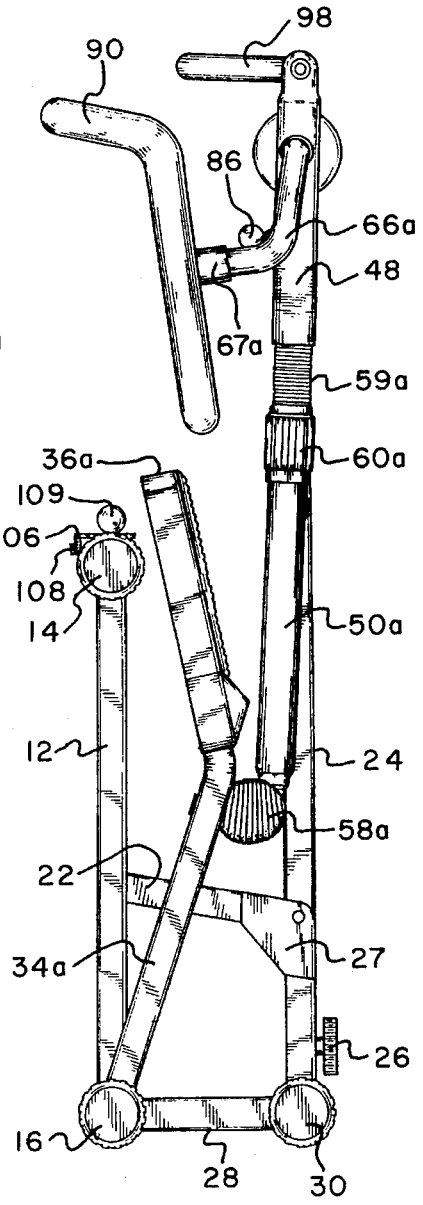
FIG. 2 is a side view of the step climber in the storage position.
Figure 3:
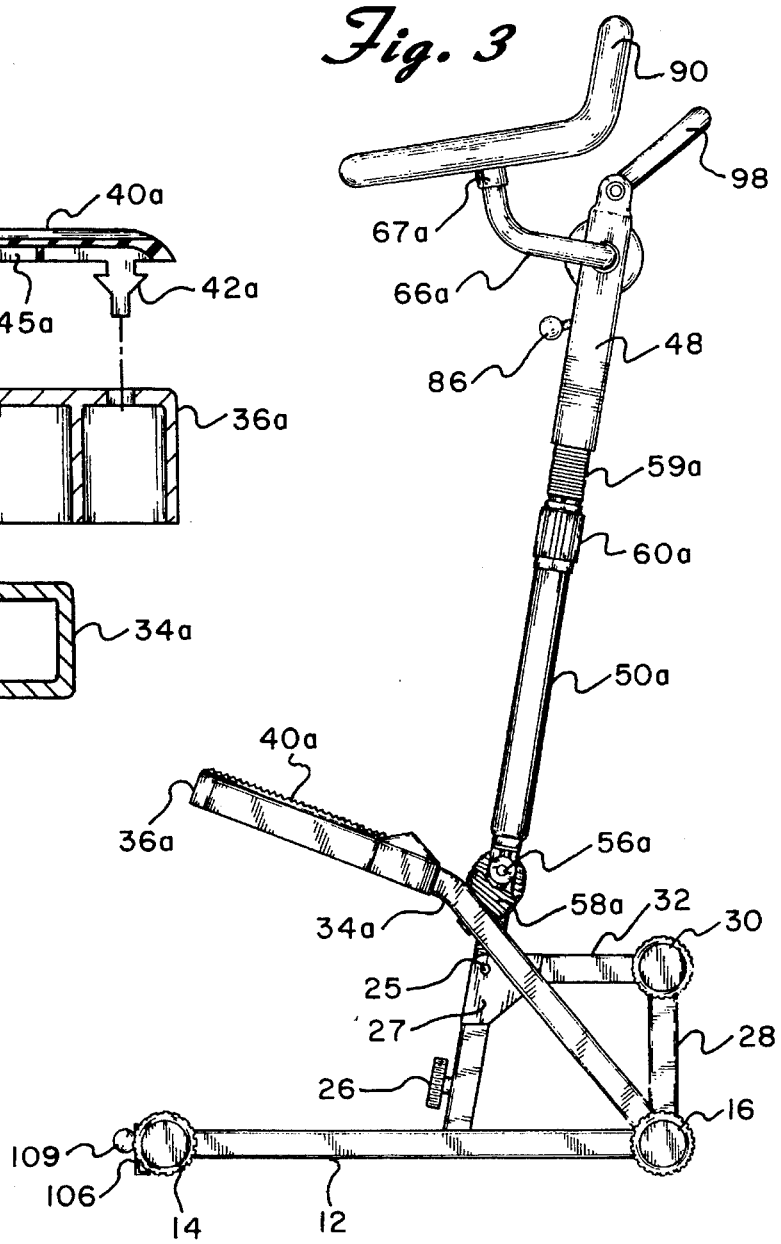
FIG. 3 is a side view of the step climber in the operating position.

Referring back to FIG. 1, upper frame 48 is secured atop main strut 24. Right and left resistance means **50*a* and 50*b* are connected to a corresponding stepping member 34*a* and 34*b* and to the upper frame 48. Again, while only one resistance means will be described in detail, it should be understood that the description equally applies to the other resistance means. Resistance means 50*a* has a top 52*a* and a bottom 54*a*. Bottom 54*a* is connected to stepping member 34*a* through the use of a double pivot joint 56*a* as shown in FIG. 3. Top 52*a* is attached to the upper frame 48. In a preferred embodiment, the resistance means 50*a* comprises a resistance cylinder and a piston rod. The resistance means 50*a* can be of the pneumatic or hydraulic type. Lower telescoping boot 58*a* surrounds the double pivot joint 56*a* as illustrated in FIGS. 1–3**.

Figure 13:
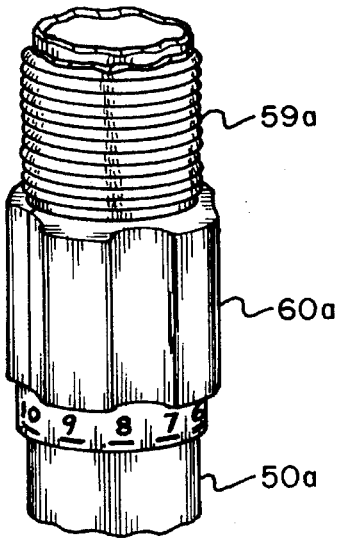
FIG. 13 is a partial view of the resistance means showing the adjustment valve and upper boot.

Similarly, upper telescoping boot **59*a* surrounds top 52*a* of resistance means 50*a* so that the piston rod (not shown) is not exposed. Adjustment valve 60*a* is secured to the resistance means 50*a* at the bottom of boot 59*a* for allowing the user to manually select a desired level of tension (see FIG. 13**).

Figure 8:
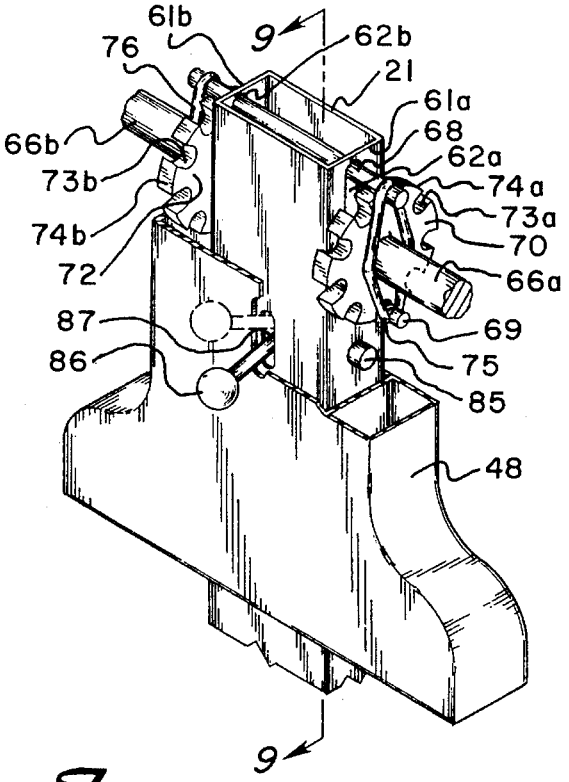
FIG. 8 is a rear perspective view of the upper frame shown in partial cross-section.
Figure 10A:
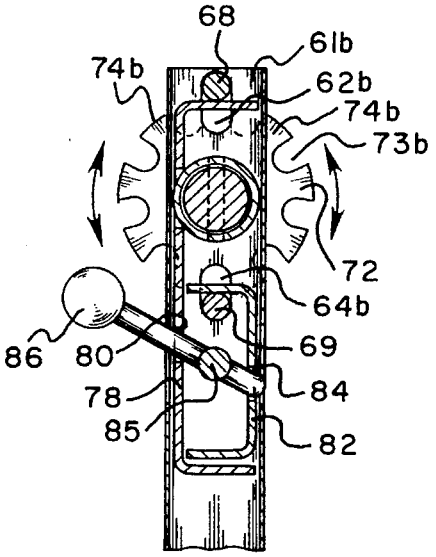
FIG. 10*a* is a side cross-sectional view taken along lines 10*a*—10*a* of FIG. 9.
Figure 9:
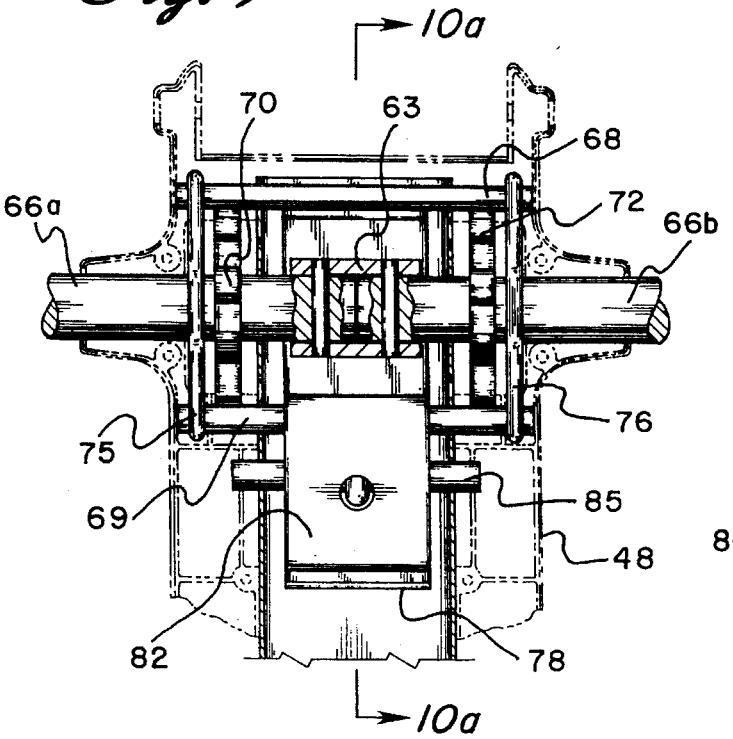
FIG. 9 is a cross-sectional view taken along lines 9—9 of FIG. 8.
Figure 10B:
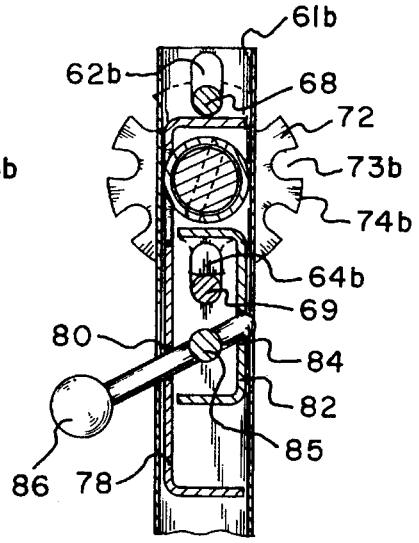
FIG. 10*b* is a side cross-sectional view showing the upper rod secured in the notches of the wheels.

Referring to FIGS. 8–10, the outer segment 21 of main strut 24 has a right side wall **61*a* and a left side wall 61*b*. Upper slot 62*a* and lower slot 64*a* are formed in the right side wall 61*a* of outer segment 21. Similarly, upper slot 62*b* and lower slot 64*b* are formed in the left side wall 61*b* of outer segment 21 as illustrated in FIGS. 10*a* and 10*b*. Right curved bar 66*a* has one end inserted through the upper frame 48 and rotatably mounted in the right side 61*a* of outer segment 21. Left curved bar 66*b* has one end inserted through the upper frame 48 and rotatably mounted in the left side wall 61*b* of outer segment 21. Coupling means 63 (FIG. 9) joins the ends of the bars 66*a* and 66*b*** together so that they will move in unison.

Upper engaging rod 68 is movably mounted in and extends through upper slots **62*a* and 62*b* of the outer segment 21 (see FIG. 8). Lower engaging rod 69 is movably mounted in and extends through the lower slots 64*a* and 64*b* of the outer segment 21. The right curved bar 66*a* extends through the hub of right wheel 70 and is securely fastened thereto. Similarly, the left curved bar 66*b* extends through and is fastened to the hub of left wheel 72**.

A plurality of notches **73*a* are formed around the periphery of right wheel 70. Similarly, a plurality of notches 73*b* are formed around the periphery of left wheel 72. The wheels 70 and 72 also have a plurality of flat teeth 74*a* and 74*b*, respectively, which are formed adjacent notches 73*a* and 73*b*. Right tension band 75 is positioned around upper engaging rod 68, curved bar 66*a* and lower engaging rod 69. Left tension band 76 is positioned in a like manner. Bands 75 and 76 tend to pull upper and lower rods 68 and 69 toward one another. When one of the rods is located in notches 73*a* and 73*b*, the other rod is forced against teeth 74*a* and 74*b*. Rotation of the wheels 70 and 72 and the attached curved bars 66*a* and 66*b* is prevented when either rod is engaged in the notches of the wheels 70 and 72**.

Elongated C-shaped bracket 78 is movably mounted in the outer segment 21 of the main strut 24. The vertical wall of bracket 78 has an aperture 80 formed therein. C-shaped bracket 82 is also movably mounted in main strut 24 and has an aperture 84 formed in the vertical wall thereof. Aperture 84 is positioned so as to be slightly above aperture 80. Pin 86 is inserted through slot 87 of the upper frame 48, through aperture 80 in elongated bracket 78 and through aperture 84 in bracket 82 so that the brackets are secured in the outer segment 21 of the main strut 24. Pin 86 is mounted for rotation in the main strut 24 about pivot point 85 so that it can be manually moved from a first position (see FIG. **10*b*) to a second position (see FIG. 10*a*). When the pin 86 is moved to the second position, bracket 82 is moved downward thereby moving lower rod 69 down slot 64*a* while bracket 78 is moved upward thereby moving upper rod 68 up slot 62*a* against the elastic restoring force of bands 75 and 76. Neither rod 68 nor rod 69 is engaged in notches 73*a* and 73*b* when the pin is in the second position. Accordingly, the curved bars 66*a* and 66*b* are free to rotate with the wheels 70 and 72 when the pin 86** is in the second position.

In the preferred embodiment, right curved bar **66*a* is L-shaped and has an upwardly curved end portion as shown in FIGS. 2 and 3. Left curved bar 66*b* is similarly shaped and has an upwardly curved end portion. Handlebar 90 is secured atop the right and left tube ends 67*a*, 67*b* (see FIG. 1**). The handlebar is preferably in the form of a closed loop and is shaped to provide both comfort and support to the user of the step climber exercise machine.

While the handlebar arrangement has been specifically described for use in conjunction with a step climber, it should be understood that the same is not limited thereto. Similar handlebars can be used with other exercise machines such as a bicycle, a treadmill or the like.

In the preferred embodiment, an adjustable display means 98 is mounted atop the upper frame 48. The display means 98 is equipped with a computer to provide the user with a variety of information such as the user's heart rate, how many calories are being burned and how much time is remaining to complete the workout.

Figure 11:
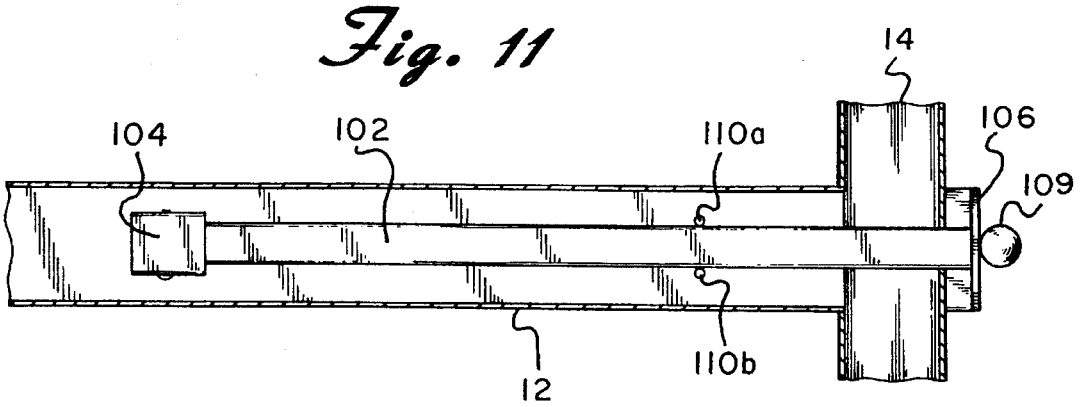
FIG. 11 is a partial cross-sectional view of the support bar telescopically mounted in the base member.
Figure 12:
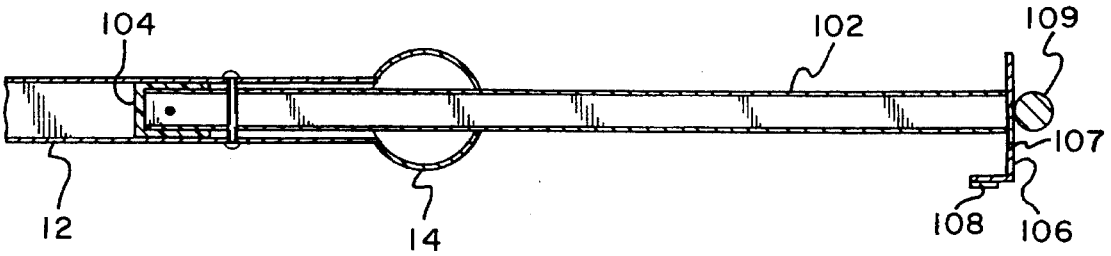
FIG. 12 is a partial side cross-sectional view of the support bar telescopically mounted in the base member.

Referring to FIGS. 11 and 12, the step climber exerciser of the present invention is designed to allow the user to perform exercises with his or her posterior extending passed the foot supporting segments 36*a*, 36*b* of stepping members 34*a*, 34*b*. This is accomplished by having a support bar 100 telescopically mounted through the transverse rear segment 14 and in the base member 12. The support bar 100 includes square tube 102 having a stop cap 104 located on one end and a balancing support 106 located at the other end. The balancing support 106 preferably has a vertical portion 107 and a horizontal portion 108. The horizontal portion 108 enhances the stability of the step climber. A knob 109 is secured to the vertical portion 107 of the balancing support 106 for aiding in the removal of the support bar 100 from the transverse rear segment 14.

Stop guides 110*a*, 110*b* are secured to base member 12 on both sides of square tube 102 for engaging stop cap 104. More specifically, when balancing support 106 is manually pulled away from transverse rear segment 14 a sufficient distance, stop cap 104 contacts stop guides 110*a*, 110*b* thereby preventing further removal of support bar 100 from transverse rear segment 14. When the step climber 10 is in the operating condition, support bar 100 is extended. Therefore, if the user of the step climber decides to concentrate the muscles on the back of the leg as well the glutimus maximus muscles while working out, the person is free to stick his or her posterior out passed the foot supporting segments 36*a*, 36*b* without causing the step climber to tip over. This is because the support bar 100 provides the necessary balance to prevent such an occurrence.

To facilitate an understanding of the principles associated with the foregoing apparatus, its operation will now be briefly described. Before using the stair climber, the user first pulls support bar 100 from base member 12 until stop cap 104 contacts stop guides 110*a*, 110*b* and can extend no further. The user then sets adjustment valves 60*a*, 60*b* to a desired level of resistance. To increase the resistance of foot supporting segments 36*a*, 36*b* the valves are moved toward closing.

Next, the person adjusts the handlebar 90 to a level suited to his or her particular measurements. This is accomplished by manually lifting pin 86 upward so that rods 68 and 69 are disengaged from notches 73*a* and 73*b* in wheels 70 and 72 in the manner described above. The handlebar 90 is then free to rotate. Once a desired position is obtained, the pin 86 is released and the elastic restoring force of the bands 75 and 76 cause one of the rods 68 and 69 to engage a pair of notches 73*a* and 73*b* while the other rod is pressed against flat teeth 74*a* and 74*b* of wheels 70 and 72.

A person wishing to exercise steps onto foot supporting segments 36*a*, 36*b*. The user then grasps handlebar 90, which is secured to upper frame 48. He or she may begin exercising by placing downward force on the foot supporting segments 36*a*, 36*b*. The downward force on the foot supporting segments is met with directly related opposing forces from resistance means 50*a*, 50*b* respectively.

After an exercise session is completed, the step climber exercise machine can be folded up and stored away. This is accomplished by manually inserting support bar 100 through transverse rear segment 14 and into base member 12. The display means 98 is folded downward. Handlebar 90 is folded toward stepping members 34*a*, 34*b* by lifting pin 86 upward so that the rods 68 and 69 are disengaged from notches 73*a* and 73*b* so that the handlebar is free to rotate. Pin 86 is then released and the elastic restoring force of the bands 75 and 76 cause one of the rods 68 and 69 to engage a pair of notches to lock handlebar 90 in place.

Screw knob 26 is unscrewed from the inner segment 23 of main strut 24 and channel member 22. The inner segment 23 is rotated about pivot point 25 and inserted into horizontal housing 32 (see FIGS. 6 and 7). The screw knob 26 is then threaded through the horizontal housing 32 and the inner segment 23 of main strut 24 so that the main strut is secured to the horizontal housing. The step climber is then in its storage position where it can be conveniently stored away until it is once again ready for use.

The present invention may be embodied in other specific forms without departing from the spirit or essential attributes thereof and accordingly reference should be made to the appended claims rather than to the foregoing specification as indicating the scope of the invention.

We claim:

1. In an exercise machine of the type having a base frame, laterally spaced foot support members carried by said base frame, a main strut attached to said base member and extending upwardly therefrom, a handlebar for providing support for a person and means for adjustably securing said handlebar to said main strut wherein said means for adjustably securing said handlebar to said main strut includes:

an upper frame positioned atop said main strut;

a wheel having a hub, said wheel further having a plurality of notches formed around the periphery of said wheel;

an axle secured to said hub of said wheel, said axle being rotatably mounted in and extending through said upper frame, said handlebar being attached to and movable with said axle, and means selectively movable into and out of said notches for locking said handlebar in place wherein said selectively movable means for locking said handlebar in place comprises a rod extending through said upper frame and said mainstrut, said rod being engageable with one of said plurality of notches of said wheel for securing said handlebar in a predetermined position.

2. The exercise machine of claim 1 wherein said handlebar is in the form of a enclosed loop.

3. In an exercise machine of the type having a base frame, laterally spaced foot support members carried by said base frame, a main strut attached to said base member and extending upwardly therefrom, a handlebar for providing support for a person and means for adjustably securing said handlebar to said main strut wherein said means for securing said handlebar to said main strut includes:

an upper frame positioned atop said main strut, said upper frame having a left side and a right side;

a right wheel and a left wheel, each of said wheels having a hub and a plurality of notches formed around the periphery of said wheels;

a right curved bar extending through said hub of said right wheel and a left curved bar extending through said hub of said left wheel, said right curved bar being rotatably mounted in and extending through said right side of said upper frame, said left curved bar being rotatably mounted in and extending through said left side of said upper frame, said handlebar being attached to and movable with said curved bars, and means selectively movable into and out of said notches for locking said handlebar in place.

4. The exercise machine of claim 3 wherein said selectively movable means for locking said handlebar in place comprises:

an upper rod movably mounted in and extending through said main strut;

a lower rod movably mounted in and extending through said main strut, and means for engaging one of said rods in one of said plurality of notches in said right wheel and in one of said plurality of notches in said left wheel.

5. The exercise machine of claim 4 wherein said engaging means comprises a right tension band being secured around said upper rod and said lower rod and a left tension band being secured around said upper rod and said lower rod, said tension bands causing said rods to move toward one another thereby allowing one of said rods to engage a notch in said right wheel and a notch in said left wheel.

6. The exercise machine of claim 5 further comprising means for disengaging said rod from said notches in said right and left wheels.

7. The exercise machine of claim 6 wherein said disengaging means comprises:

a reduced bracket movably mounted in said main strut, said reduced bracket having an aperture formed therein;

an elongated bracket movably mounted in said main strut, said elongated bracket having an aperture formed therein, said elongated bracket extending above said reduced bracket;

a pin inserted through said aperture in said elongated bracket and said aperture in said reduced bracket, said pin being mounted for rotation in said main strut so that said pin can be moved from a first position, wherein said tension bands cause one of said rods to engage a notch in said right wheel and a notch in said left wheel, to a second position wherein said elongated bracket is moved up said main strut so that said bracket engages said upper rod thereby disengaging said upper rod from said notches in said wheels and said reduced bracket is moved down said main strut so that said lower rod is disengaged from said notches in said wheels thereby allowing said wheels and said curved bars to freely rotate about said main strut.

8. The exercise machine in claim 7 wherein said handlebar is in the form of an enclosed loop.

* * * * *